US009728850B2

(12) United States Patent
Athley et al.

(10) Patent No.: US 9,728,850 B2
(45) Date of Patent: Aug. 8, 2017

(54) COMMUNICATION SYSTEM NODE COMPRISING A TRANSFORMATION MATRIX

(75) Inventors: Fredrik Athley, Kullavik (SE); Sven Petersson, Savedalen (SE)

(73) Assignee: TELEFONAKTIEBOLAGET LM ERICSSON (PUBL), Stockholm (SE)

( * ) Notice: Subject to any disclaimer, the term of this patent is extended or adjusted under 35 U.S.C. 154(b) by 856 days.

(21) Appl. No.: 13/580,896

(22) PCT Filed: Feb. 25, 2010

(86) PCT No.: PCT/EP2010/052382

§ 371 (c)(1),
(2), (4) Date: Aug. 23, 2012

(87) PCT Pub. No.: WO2011/103918

PCT Pub. Date: Sep. 1, 2011

(65) Prior Publication Data

US 2012/0326928 A1 Dec. 27, 2012

(51) Int. Cl.
*H01Q 3/40* (2006.01)
*H01Q 3/30* (2006.01)
(Continued)

(52) U.S. Cl.
CPC ..... *H01Q 3/40* (2013.01); *H01Q 1/246* (2013.01); *H01Q 3/30* (2013.01); *H01Q 25/00* (2013.01)

(58) Field of Classification Search
CPC .. H01Q 3/40; H01Q 3/24; H01Q 3/30; H01Q 25/00; H01Q 1/246
See application file for complete search history.

(56) References Cited

U.S. PATENT DOCUMENTS 4,532,520 A * 7/1985 Hislop ..... G01S 13/424 342/372
5,831,977 A * 11/1998 Dent ..... H04B 7/086 370/335
(Continued)

FOREIGN PATENT DOCUMENTS

CN 1331854 A 1/2002
CN 1610425 A 4/2005
(Continued)

OTHER PUBLICATIONS

Office Action dated Feb. 28, 2014, issued in Chinese Patent Application No. 201080064548.2, 16 pages.
(Continued)

*Primary Examiner* — Cassie Galt
(74) *Attorney, Agent, or Firm* — Rothwell, Figg, Ernst & Manbeck, P.C.

(57) ABSTRACT

The present invention relates to a node (1) in a wireless communication system, the node (1) comprising at least one antenna (2) which is arranged to cover a first sector (3) in a first direction (4) and comprises a number (A) of antenna ports (5, 6, 7, 8), which number (A) is at least four. The antenna ports (5, 6, 7, 8) are connected to a transformation matrix (9) which is arranged for transforming the antenna ports (5, 6, 7, 8) to at least a first set (S1) of virtual antenna ports (10, 11) and a second set (S2) of virtual antenna ports (12, 13), each set (S1, S2) comprising a number (B) of virtual antenna ports (10, 11; 12, 13). The present invention also relates to a corresponding method.

17 Claims, 4 Drawing Sheets

(51) Int. Cl.
*H01Q 1/24* (2006.01)
*H01Q 25/00* (2006.01)

(56) References Cited

U.S. PATENT DOCUMENTS

| | | | | |
|---|---|---|---|---|
| 6,218,987 | B1 * | 4/2001 | Derneryd et al. | 342/373 |
| 6,496,142 | B1 | 12/2002 | Iinuma | |
| 6,496,157 | B1 | 12/2002 | Mottier | |
| 6,546,236 | B1 * | 4/2003 | Canada et al. | 455/304 |
| 7,123,943 | B2 * | 10/2006 | Ylitalo | 455/562.1 |
| 7,200,421 | B2 | 4/2007 | Narita | |
| 7,548,764 | B2 * | 6/2009 | Jin et al. | 455/562.1 |
| 8,463,323 | B2 * | 6/2013 | Li et al. | 455/562.1 |
| 2005/0085266 | A1 | 4/2005 | Narita | |
| 2006/0068848 | A1 | 3/2006 | Shapira et al. | |
| 2010/0004022 | A1 | 1/2010 | Lorentzon | |
| 2010/0120441 | A1 * | 5/2010 | Wan | H04W 16/24 455/446 |
| 2011/0310994 | A1 * | 12/2011 | Ko | H04B 7/0639 375/295 |

FOREIGN PATENT DOCUMENTS

| | | | |
|---|---|---|---|
| CN | 101253751 | A | 8/2008 |
| JP | 2000201012 | A | 7/2000 |
| JP | 2005124096 | A | 5/2005 |
| JP | 2005252380 | A | 9/2005 |
| WO | 2008030035 | A2 | 3/2008 |

OTHER PUBLICATIONS

Japanese Office Action issued in Japanese Patent Application No. 2012-554224 on Jan. 7, 2014.

* cited by examiner

COMMUNICATION SYSTEM NODE COMPRISING A TRANSFORMATION MATRIX

CROSS-REFERENCE TO RELATED APPLICATION

This application is a 35 U.S.C. §371 National Phase Entry Application from PCT/EP2010/052382, filed Feb. 25, 2010, designating the United States, the disclosure of which is incorporated herein in its entirety by reference.

TECHNICAL FIELD

The present invention relates to a node in a wireless communication system, the node comprising at least one antenna, which is arranged to cover a first sector in a first direction and comprises a number of antenna ports, which number is at least four.

The present invention also relates to a method in a wireless communication system node using at least one antenna covering a first sector in a first direction and having a number of antenna ports being at least four.

BACKGROUND

In a node in a wireless communication system, there is sometimes a need for re-using an antenna arrangement designed for a first cellular system in a second cellular system. However, the second cellular system may have requirements on the antenna arrangement which is different from the requirements of the first cellular system.

One example of such a situation is if an SCDMA (Spatial Code Division Multiple Access) system, a first cellular system, is to be migrated to a 3GPP (3rd Generation Partnership Project) LTE (Long Term Evolution) system, a second cellular system. The SCDMA system may have been deployed with array antennas that have more antenna ports than is needed for the transmission modes used in LTE. A possible way to reuse the antennas in such a scenario is to split the sectors in the SCDMA system into two sectors for the LTE system. The number of antenna ports per sector in the LTE system is then half the number of antenna ports per sector in the SCDMA system.

Generally, a straightforward solution to this problem is to replace existing antennas with new antennas that are designed for the second cellular system. However, replacing antennas in an entire system is a very costly operation, making reuse of existing antennas an attractive alternative.

There is thus a desire to reuse an existing antenna arrangement which is to be used in a second cellular system but has been designed for a first cellular system, where the second cellular system has requirements on the antenna arrangement which is different from the requirements of the first cellular system.

SUMMARY

The object of the present invention is to reuse an existing antenna arrangement which is to be used in a second cellular system but has been designed for a first cellular system, where the second cellular system has requirements on the antenna arrangement which is different from the requirements of the first cellular system.

Said object is obtained by means of a node in a wireless communication system, the node comprising at least one antenna, which is arranged to cover a first sector in a first direction and comprises a number of antenna ports, which number is at least four. The antenna ports are connected to a transformation matrix which is arranged for transforming the antenna ports to at least a first set of virtual antenna ports and a second set of virtual antenna ports. Each set of virtual antenna ports comprises a number of virtual antenna ports, which number is less than or equal to half the number of antenna ports, but not falling below two. The sets of virtual antenna ports correspond to virtual antennas which are arranged to cover at least a second sector and a third sector in a corresponding second direction and third direction.

Said object is obtained by means of a method in a wireless communication system node using at least one antenna covering a first sector in a first direction and having a number of antenna ports being at least four. The method comprises the steps: connecting the antenna ports to a transformation matrix and using the transformation matrix for transforming the antenna ports to at least a first set of virtual antenna ports and a second set of virtual antenna ports, each set of virtual antenna ports having a number of virtual antenna ports. The number of virtual antenna ports is less than or equal to half the number of antenna ports, but not falling below two. The sets of virtual antenna ports correspond to virtual antennas which are used to cover at least a second sector and a third sector in a corresponding second direction and third direction.

In an example of the present invention, the first direction is positioned between the second direction and the third direction.

In another example, the transformation matrix is arranged such that the virtual antennas have essentially equal antenna radiation patterns in each sector.

In another example, the node further comprises a radio remote unit, RRU, which in turn comprises corresponding amplifiers which are connected to corresponding antenna ports.

The transformation matrix may be realized in either hardware, software or a combination of hardware and software.

Other examples are evident from the dependent claims.

A number of advantages is obtained by means of the present invention. For example, a solution is provided for reusing antennas from one sectorized cellular system to another when the requirements on the number of available antenna ports per sector are different in the two systems

BRIEF DESCRIPTION OF THE DRAWINGS

The present invention will now be describe more in detail with reference to the appended drawings, where.

DETAILED DESCRIPTION

Figure 1:
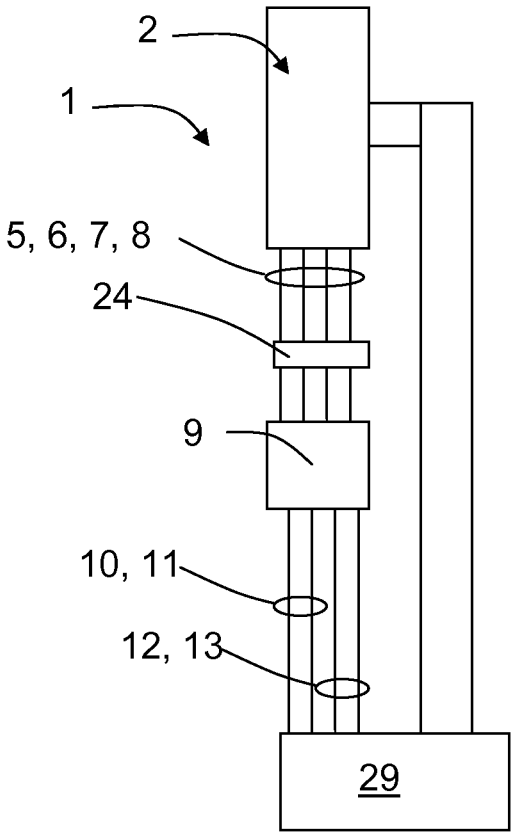
FIG. 1 shows a schematic view of a node according to the present invention.

With reference to FIG. 1, there is a node 1 in a wireless communication system, where the node 1 comprising an antenna 2 which comprises four antenna ports 5, 6, 7, 8.

Figure 3:
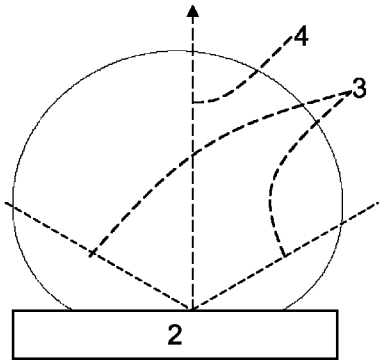
FIG. 3 shows a schematic view of an antenna radiation pattern.

With reference also to FIG. 3, the antenna 2 is arranged to cover a first sector 3 in a first direction 4.

Figure 2:
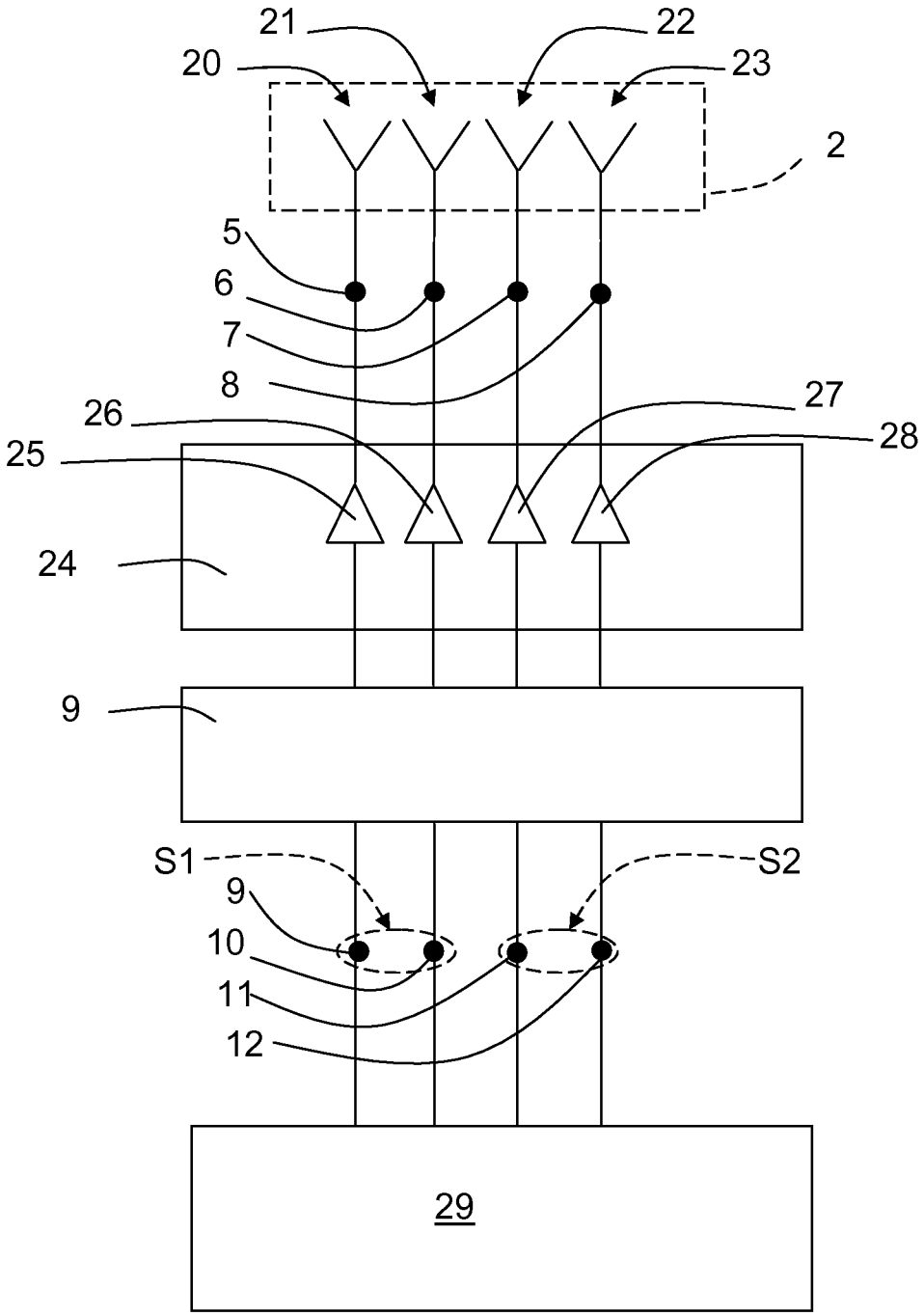
FIG. 2 shows a schematic view of an antenna arrangement and radio chains according to the present invention.

With reference also to FIG. 2, the antenna 2 comprises antenna elements 20, 21, 22, 23, where each antenna element is connected to a corresponding antenna port 5, 6, 7, 8. Each antenna element is shown as a single antenna element, but this is only a schematical representation; each antenna element may in fact constitute an antenna element column comprising a number of physical antenna elements. When the term "antenna element" is used below, it should be understood that it may refer to a single antenna element, as shown in FIG. 2, or a a number of antenna elements in an antenna element column.

The beams of the antenna elements all point in the same direction, typically boresight, and have a beamwidth so that the desired sector coverage of said first sector 3 is obtained.

According to the present invention, the antenna ports 5, 6, 7, 8 are connected to a transformation matrix 9 which is arranged for transforming the antenna ports 5, 6, 7, 8 to a first set S1 of virtual antenna ports 10, 11 and a second set S2 of virtual antenna ports 12, 13. In this example, each set S1, S2 of virtual antenna ports has two virtual antenna ports 10, 11; 12, 13. These sets S1, S2 are preferably connected to a main unit, MU, 29.

Figure 4:
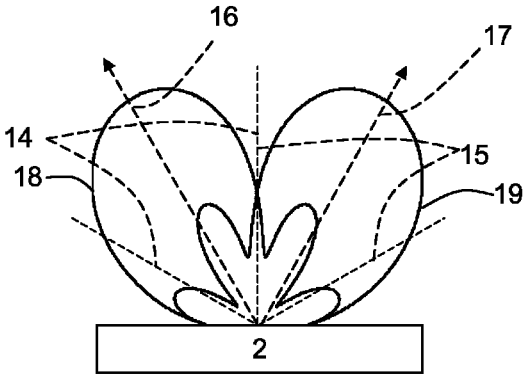
FIG. 4 shows a schematic view of virtual antenna radiation patterns.

With reference also to FIG. 4, the sets S1, S2 of virtual antenna ports 10, 11; 12, 13 correspond to virtual antennas which are arranged to cover at least a second sector 14 and a third sector 15 in a corresponding second direction 16 and third direction 17.

Thus the first sector 3 has been split into the second sector 14 and the third sector 15, where the second sector 14 is covered by the first set S1 of virtual antenna elements and the third sector 15 is covered by the second set S2 of virtual antenna elements.

For such a transition to be possible, the reconfiguration network 9 applied to the antenna ports 5, 6, 7, 8 is necessary. For example, if a reconfiguration network can be designed so that the resulting antenna arrangement properties are suitable for the LTE system, this provides a smooth migration path from an SCDMA system to LTE with regard to the antenna arrangement.

According to an example, the virtual antenna elements have such properties such that the first set S1 of virtual antenna elements have a beam direction and width such that the desired coverage of the second sector 14 is obtained, while at the same time interference from/to adjacent sectors is minimized. The same should hold for the second set S2 of virtual antenna elements and the third sector 15.

According to another example, the virtual antenna elements should have displaced phase centers so that, for example, beamforming and codebook based precoding can be applied in the second sector 14 and the third sector 15.

According to another example, with reference to FIG. 1 and FIG. 2, the node 1 also comprises a so-called remote radio unit (RRU) 24, which is connected between the antenna ports 5, 6, 7, 8 and the transformation matrix 9, and comprises corresponding amplifiers 25, 26, 27, 28. This drawing shown is a simplified drawing of an RRU where only the transmitter chains are shown, there may also be not shown receiver chains, since the antenna 2 may work reciprocally within the frame of the present invention.

When an RRU or a similar amplifier arrangement is used, the transformation matrix 9 should be designed so that all amplifiers 25, 26, 27, 28 in the transmitter chains are better or almost fully utilized.

In the following, a detailed example of the present invention will be presented with reference to FIG. 2. In this example, there are four antenna elements 20, 21, 22, 23 covering a 120° sector. The transformation matrix 9 creates two sets S1, S2 of virtual antenna elements with two elements in each set. The two sets S1, S2 of virtual antenna element are arranged to cover a 60° sector each, and thus together cover the original 120° sector. The antenna elements 20, 21, 22, 23 are here co-polarized.

The transformation matrix, W, is constructed by stacking array weight vector as columns according to $$W=[w_{B,1}w_{B,2}w_{C,1}w_{C,2}],$$

where each w is a 4×1 complex weight vector. The vector $w_{B,1}$ creates beam number 1 in sector B, and so forth. The following design of weight vectors will make the transformation matrix satisfy the desired requirements:

$$w_{B,1} = \frac{1}{\sqrt{2}}\left[0 \quad ce^{j2\pi d_1/\lambda \sin\varphi} \quad \sqrt{1-c^2}\, e^{j2\pi d_2/\lambda \sin\varphi} \quad e^{j2\pi d_3/\lambda \sin\varphi}\right]^T$$

$$w_{B,2} = \frac{1}{\sqrt{2}}\left[1 \quad \sqrt{1-c^2}\, e^{j2\pi d_1/\lambda \sin\varphi} \quad ce^{j2\pi d_2/\lambda \sin\varphi} \quad 0\right]^T$$

$$w_{C,1} = \frac{1}{\sqrt{2}}\left[0 \quad ce^{-j2\pi d_1/\lambda \sin\varphi} \quad \sqrt{1-c^2}\, e^{j2\pi d_2/\lambda \sin\varphi} \quad e^{-j2\pi d_3/\lambda \sin\varphi}\right]^T$$

$$w_{C,2} = \frac{1}{\sqrt{2}}\left[1 \quad \sqrt{1-c^2}\, e^{-j2\pi d_1/\lambda \sin\varphi} \quad ce^{j2\pi d_2/\lambda \sin\varphi} \quad 0\right]^T$$

Here, $d_k$ denotes the position along the antenna axis relative to a reference point of the k-th antenna element and λ is the carrier wavelength. Furthermore, c and ϕ are design parameters that control the resulting beam pattern of the virtual antenna elements. The amplitude taper coefficient, c, affects the beamwidth and sidelobe level, while the phase ϕ controls the pointing direction of the beams. These design parameters can be optimized with respect to a desired criterion function. Such a criterion could include, for example, sidelobe levels and cross-over levels between adjacent sectors.

The proposed solution has the following key features, making it satisfy the desired requirements:

1. Since $$|w_{B,1,k}|^2+|w_{B,2,k}|^2+w_{C,1,k}|^2+|w_{C,2,k}|^2=1,\ k=1,\ldots,4,$$

where $w_{B,1,k}$ denotes the k-th element in $w_{B,1}$, all power amplifiers are fully utilized.
2. Since $w_{B,1,1}=w_{B,2,4}=0$ and $w_{C,1,1}=W_{C,2,4}=0$ the virtual antenna elements will have displaced phase centers, enabling beamforming and codebook based precoding.
3. By a judicious choice of the design parameters c and ϕ, the beampatterns of the virtual elements can be designed so that desired coverage of the respective second sector 14 and third sector 15 is obtained.

The items (1)-(3) above are a part of the present example, and are not necessary for the present invention in its general form.

Figure 5:
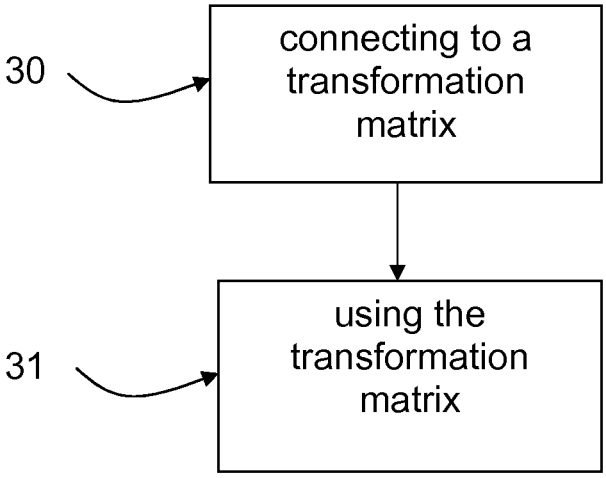
FIG. 5 shows a flowchart for a method according to the present invention.

With reference to FIG. 5, the present invention also relates to a method in a wireless communication system node using at least one antenna 2 covering a first sector 3 in a first direction 4 and having a number A of antenna ports 5, 6, 7, 8 being at least four. The method comprises the steps:

30: connecting the antenna ports 5, 6, 7, 8 to a transformation matrix 9; and

31: using the transformation matrix 9 for transforming the antenna ports 5, 6, 7, 8 to at least a first set S1 of virtual antenna ports 10, 11 and a second set S2 of virtual antenna ports 12, 13, each set S1, S2 of virtual antenna ports having a number B of virtual antenna ports 10, 11; 12, 13, the number B of virtual antenna ports 10, 11; 12, 13 being less than or equal to half the number A of antenna ports 5, 6, 7, 8, but not falling below two, the sets 51, S2 of virtual antenna ports 10, 11; 12, 13 corresponding to virtual antennas which are used to cover at least a second sector 14 and a third sector 15 in a corresponding second direction 16 and third direction 17.

The invention is not limited to the above examples, but may vary freely within the scope of the appended claims. For example, the example of four antenna columns is just an illustration to explain the concept. As discussed previously, the number of antenna elements can be any suitable number for each column, generally the concept could be applied to an antenna with N antenna elements. The sector covered by the physical antenna elements is then split into two sectors covered by N/2 virtual antenna elements each.

Although described for single polarized antenna elements, the concept can also be applied to dual-polarized array antennas. The proposed transformation matrix is then applied on each polarization. Then, for a certain sector that is covered by virtual antenna elements, the virtual antenna elements of the same polarization should have different phase centers, but it is not necessary that the virtual antenna elements of different polarizations or virtual antenna elements covering different sectors should have different phase centers.

The number A of antenna ports may vary, but is at least four. Each set S1, S2 of virtual antenna ports have a number B of virtual antenna ports 10, 11; 12, 13, which number B of virtual antenna ports 10, 11; 12, 13 is less than or equal to half the number A of antenna ports 5, 6, 7, 8, but not falling below two.

The node can comprise any suitable antenna arrangement, for example a 3-sector system comprising three antennas, the beamwidth typically being 65° or 90° for a 3-sector system.

The weight vectors described are only defined by way of examples. Many other weight vectors are conceivable.

It is also possible to use the present invention to reduce the number of antenna ports from N to N/2 without increasing the number of sectors, e.g., reconfigure 8 antenna ports in a 3-sector system to 4 antenna ports in a 3-sector system.

The transformation matrix may be placed in the RRU, and may be realized in hardware as well as software, or a combination of both.

The sets S1, S2 are preferably connected to a main unit, MU, 29, but may of course be connected to any other suitable part.

When the virtual antennas are indicated to have equal antenna radiation patterns in each sector in this context, this is not meant as those radiation patterns being mathematically exactly equal, but equal to an extent of what is practically possible to achieve in this field of technology.

The invention claimed is:

1. A node in a wireless communication system, the node comprising:

at least one antenna configured to cover a first sector in a first direction and comprising a number N of antenna ports, wherein the number N of antenna ports is at least four and is even; and a circuit connected to the antenna ports and configured to transform the antenna ports with a transformation matrix, wherein the transformation matrix is configured to apply a linear transformation to the N antenna ports to transform them to at least a first set (S1) of N/2 virtual antenna ports and a second set (S2) of N/2 virtual antenna ports, wherein N/2 is not less than two, where the sets (S1, S2) of virtual antenna ports correspond to virtual antennas which are configured to cover at least a second sector and a third sector in a corresponding second direction and third direction, respectively, wherein the first sector is covered by the N antenna ports, and wherein the transformation matrix is configured to cause the second sector (B) to be covered by a beam formed from the N/2 virtual antenna ports of the first set (S1) and to cause the third sector (C) to be covered by a beam formed from the N/2 virtual antenna ports of the second set (S2), wherein the transformation matrix is configured to control a beamwidth and a beam direction of a beam formed by the virtual antennas of the second sector or of the third sector, wherein the transformation matrix is formed by stacking array weight vectors as columns according to $$W=[w_{B,1}w_{B,2}w_{C,1}w_{C,2}],$$

where each w is a complex weight vector and vector $w_{k,n}$ creates beam number n in sector k, and where denotes the number of sectors and N denotes the number of beams per sector, wherein $$w_{B,1} = \frac{1}{\sqrt{2}}\left[0 \quad ce^{j2\pi d_1/\lambda \sin\varphi} \quad \sqrt{1-c^2}\, e^{j2\pi d_2/\lambda \sin\varphi} \quad e^{j2\pi d_3/\lambda \sin\varphi}\right]^T$$

$$w_{B,2} = \frac{1}{\sqrt{2}}\left[1 \quad \sqrt{1-c^2}\, e^{j2\pi d_1/\lambda \sin\varphi} \quad ce^{j2\pi d_2/\lambda \sin\varphi} \quad 0\right]^T$$

$$w_{C,1} = \frac{1}{\sqrt{2}}\left[0 \quad ce^{-j2\pi d_1/\lambda \sin\varphi} \quad \sqrt{1-c^2}\, e^{-j2\pi d_2/\lambda \sin\varphi} \quad e^{-j2\pi d_3/\lambda \sin\varphi}\right]^T$$

$$w_{C,2} = \frac{1}{\sqrt{2}}\left[1 \quad \sqrt{1-c^2}\, e^{-j2\pi d_1/\lambda \sin\varphi} \quad ce^{-j2\pi d_2/\lambda \sin\varphi} \quad 0\right]^T,$$

and wherein $d_k$ denotes a position along an antenna axis relative to a reference point of the k-th antenna element, $\lambda$ is the carrier wavelength, c is an amplitude taper coefficient, and $\phi$ is a phase parameter that controls a pointing direction of the beams.

2. The node according to claim 1, wherein the first direction is positioned between the second direction and the third direction.

3. The node according to claim 1, wherein the transformation matrix is configured such that the virtual antenna ports cause equal antenna radiation patterns in each sector.

4. The node according to claim 3, wherein the at least one antenna is a dual-polarized array antenna having a plurality of polarizations, and wherein the circuit is configured to apply the transformation matrix to each of the polarizations, and wherein the phase centres of the virtual antennas that are configured for covering a certain sector are separated by more than 0.4 wavelengths, where the wavelength corresponds to the centre of a frequency band used.

5. The node according to claim 1, wherein the at least one antenna comprises co-polarized antenna elements.

6. The node according to claim 1, further comprising a radio remote unit (RRU) that comprises corresponding amplifiers which are connected to corresponding antenna ports.

7. The node according to claim 1, wherein the transformation matrix is implemented by hardware or a combination of hardware and software.

8. The node according to claim 1, wherein the transformation matrix is formed by stacking array weight vectors as columns according to $$W=[w_{1,1} \ldots w_{k,n} \ldots W_{K,N}]$$

where each w is a complex weight vector and vector $w_{k,n}$ creates beam number n in sector k, and where K denotes the number of sectors and N denotes the number of beams per sector.

9. A method in a wireless communication system node using at least one antenna covering a first sector in a first direction and having a number N of antenna ports, wherein N is at least four and is even, the method comprising:

connecting the antenna ports to a circuit configured to transform the antenna ports with a transformation matrix; and using the transformation matrix to apply a linear transformation to the N antenna ports to transform them to at least a first set (S1) of N/2 virtual antenna ports and a second set (S2) of N/2 virtual antenna ports, wherein N/2 is not less than two, the sets (S1, S2) of virtual antenna ports corresponding to virtual antennas which are used to cover at least a second sector and a third sector in a corresponding second direction and third direction, respectively, wherein the first sector is covered by the N antenna ports, and wherein the transformation matrix is configured to cause the second sector (B) to be covered by a beam formed from the N/2 virtual antenna ports of the first set (S1) and to cause the third sector (C) to be covered by a beam formed from the N/2 virtual antenna ports of the second set (S2), wherein the use of the transformation matrix controls a beamwidth and a beam direction of a beam formed by the virtual antennas of the second sector or of the third sector, wherein the transformation matrix is formed by stacking array weight vectors as columns according to $$W=[w_{B,1} w_{B,2} w_{C,1} w_{C,2}],$$

where each w is a complex weight vector and vector $w_{k,n}$ creates beam number n in sector k, and where K denotes the number of sectors and N denotes the number of beams per sector, wherein $$w_{B,1} = \frac{1}{\sqrt{2}}\left[\,0 \quad ce^{j2\pi d_1/\lambda \sin\varphi} \quad \sqrt{1-c^2}\, e^{j2\pi d_2/\lambda \sin\varphi} \quad e^{j2\pi d_3/\lambda \sin\varphi}\,\right]^T$$

$$w_{B,2} = \frac{1}{\sqrt{2}}\left[\,1 \quad \sqrt{1-c^2}\, e^{j2\pi d_1/\lambda \sin\varphi} \quad ce^{j2\pi d_2/\lambda \sin\varphi} \quad 0\,\right]^T$$

-continued $$w_{C,1} = \frac{1}{\sqrt{2}}\left[\,0 \quad ce^{-j2\pi d_1/\lambda \sin\varphi} \quad \sqrt{1-c^2}\, e^{-j2\pi d_2/\lambda \sin\varphi} \quad e^{-j2\pi d_3/\lambda \sin\varphi}\,\right]^T$$

$$w_{C,2} = \frac{1}{\sqrt{2}}\left[\,1 \quad \sqrt{1-c^2}\, e^{-j2\pi d_1/\lambda \sin\varphi} \quad ce^{-j2\pi d_2/\lambda \sin\varphi} \quad 0\,\right]^T,$$

and wherein $d_k$ denotes a position along an antenna axis relative to a reference point of the k-th antenna element, $\lambda$ is the carrier wavelength, c is an amplitude taper coefficient, and $\phi$ is a phase parameter that controls a pointing direction of the beams.

10. The node according to claim 1, wherein the antenna ports are configured for use in a spatial code division multiple access (SCDMA) system, and wherein each of the first set (S1) and second set (S2) of virtual antenna ports is configured for use in a LTE system.

11. The node according to claim 1, wherein the second sector covers one half of the first sector, and the third sector covers the other half of the first sector.

12. The node according to claim 11, wherein the first sector covers a 120° sector, the second sector covers a 60° sector of the 120° sector, and the third sector covers another 60° sector of the 120° sector.

13. The node according to claim 1, wherein the transformation matrix has values which are configured to cause all power amplifiers connected to the antenna ports to be fully utilized.

14. The node according to claim 1, wherein the transformation matrix comprises values that are configured to cause the virtual antennas to have displaced phase centers, so as to enable beamforming and codebook based precoding.

15. The node according to claim 13, wherein the transformation matrix comprises column vectors $W_{B,1}$ and $W_{B,2}$ and $W_{C,1}$, and $W_{C,2}$ that each have 4 scalar values, wherein: $|W_{B,1,k}|^2+|W_{B,2,k}|^2+|W_{C,1,k}|^2+W_{C,2,k}|^2=1$ for all values of k greater than or equal to 1 and less than or equal to 4.

16. The node according to claim 14, wherein the transformation matrix comprises, from left to right, column vectors $W_{B,1}$ and $W_{B,2}$, and $W_{C,1}$ and $W_{C,2}$ that each has 4 scalar values, wherein the values $W_{B,1,1}$ and $W_{B,2,4}$ and $W_{C,1,1}$ and $W_{C,2,4}$ are all zero.

17. The method according to claim 9, further comprising:

configuring the antenna ports for use in a spatial code division multiple access (SCDMA) system;

configuring each of the first set (S1) and second set (S2) of virtual antenna ports for use in a LTE system; and connecting the transformation matrix to the SCDMA system.

* * * * *